US007570035B2

(12) United States Patent
Kleveland

(10) Patent No.: US 7,570,035 B2
(45) Date of Patent: Aug. 4, 2009

(54) VOLTAGE REGULATOR WITH A HYBRID CONTROL LOOP

(75) Inventor: Bendik Kleveland, Santa Clara, CA (US)

(73) Assignee: ZeroG Wireless, Inc., Sunnyvale, CA (US)

( * ) Notice: Subject to any disclaimer, the term of this patent is extended or adjusted under 35 U.S.C. 154(b) by 244 days.

(21) Appl. No.: 11/888,715

(22) Filed: Aug. 1, 2007

(65) Prior Publication Data

US 2009/0033298 A1 Feb. 5, 2009

(51) Int. Cl.
*G05F 1/40* (2006.01)
*G05F 1/56* (2006.01)

(52) U.S. Cl. ..... 323/276; 323/273

(58) Field of Classification Search ..... 323/269–276, 323/279, 280; 361/18, 91.1, 92, 111
See application file for complete search history.

(56) References Cited

U.S. PATENT DOCUMENTS

| | | | | |
|---|---|---|---|---|
| 5,309,082 | A | 5/1994 | Payne | |
| 5,978,425 | A | 11/1999 | Takla | |
| 6,661,210 | B2 * | 12/2003 | Kimball et al. | 323/268 |
| 6,680,837 | B1 * | 1/2004 | Buxton | 361/93.9 |
| 6,703,815 | B2 * | 3/2004 | Biagi | 323/280 |
| 6,809,504 | B2 | 10/2004 | Tang et al. | |
| 6,965,218 | B2 * | 11/2005 | Scoones et al. | 323/280 |
| 6,975,494 | B2 | 12/2005 | Tang et al. | |
| 6,995,474 | B1 | 2/2006 | Tang et al. | |
| 7,141,956 | B2 | 11/2006 | Chapuis | |
| 7,167,054 | B1 | 1/2007 | Dening et al. | |
| 7,323,853 | B2 * | 1/2008 | Tang et al. | 323/280 |
| 2009/0009147 | A1 * | 1/2009 | Jian | 323/280 |

OTHER PUBLICATIONS

PhD Thesis, *Current Efficient, Low Voltage, Low Drop-Out Regulators*, Gabriel Alfonso Rincon-Mora,Georgia Institute of Technology, Nov. 1996, http://users.ece.gatech.edu/~rincon/publicat/books/thesis/Ido_books.pdf.

* cited by examiner

*Primary Examiner*—Matthew V Nguyen
(74) *Attorney, Agent, or Firm*—The Mueller Law Office, P.C.

(57) ABSTRACT

A voltage regulator circuit and method are provided for regulating a voltage accurately in response to rapid variations in the regulator's load. The voltage regulator utilizes a hybrid loop; an embodiment of such utilization is exemplified by circuit 300. Amplifier 301 controls the current flowing through pass element 303 from an unregulated input voltage node $V_{in}$ to a regulated voltage output node $V_{out}$. The regulated output voltage is provided to load 311 so that the voltage across the load stays constant regardless of variations in the current it pulls. The value of the regulated voltage is set by feedback network 302 and the input voltage at node $V_{ref}$. The regulator feedback loop formed by amplifier 301, pass element 303, and feedback network 302 regulate the voltage at $V_{out}$ in response to low frequency perturbations in load 311. In response to high frequency perturbations, a sensing network triggers control circuitry 310. Such a sensing network is exemplified in this embodiment by comparators 308 and 309. In response to a trigger signal, the control circuitry adjusts the drive capability of pass element 303 to rapidly return $V_{out}$ to its regulated value. When the voltage at $V_{out}$ returns to its regulated value the drive capability of pass element 303 is reset.

20 Claims, 7 Drawing Sheets

Linear Voltage Regulator 100

Prior Art Voltage Regulator 200

Hybrid Loop Voltage Regulator 300

Hybrid Loop NMOS Voltage Regulator 400

PMOS Array Pass Element 500

PNP Array Pass Element 510

NPN Array Pass Element 520

Hybrid Loop Negative Voltage Regulator 600

Cascade of Hybrid Voltage Regulators 700

VOLTAGE REGULATOR WITH A HYBRID CONTROL LOOP

FIELD OF THE INVENTION

The invention relates generally to voltage regulator circuits, and more specifically to the transient response of linear voltage regulator circuits.

BACKGROUND OF THE INVENTION

The current required by an active electronic system is constantly in flux. Notwithstanding these current fluctuations, the power supply of an electronic system needs to provide a stable output voltage. Without a stable supply voltage digital circuitry will suffer from bit errors and analog circuitry performance will be degraded by bias point shifting. This requirement has been present in electronics circuits since their inception and is solved through the use of voltage regulators. A voltage regulator receives a supply voltage and outputs a regulated voltage to an electronic circuit. The regulated circuit is referred to as the load of the voltage regulator. Modern integrated circuits such as those found in computers and mobile phones commonly utilize linear voltage regulators. The use of linear voltage regulators is the favored method in integrated circuit applications because they provide a clean voltage supply, meaning that the regulated voltage is relatively free from noise.

There is a large body of prior art related to linear voltage regulators. A generalized diagram of a regulator circuit can be found in FIG. 1. Circuit 100 is an example of a positive voltage regulator since the regulated voltage $V_{out}$ has a lower potential than the supply voltage $V_{in}$. Negative voltage regulators provide for the opposite relationship between regulated and unregulated voltage. In a linear voltage regulator pass element 104 is an active device, such as a bipolar junction transistor (BJT) or metal-oxide semiconductor (MOS) field effect transistor, connected between the unregulated supply voltage and the regulated output voltage. The active device is controlled by a feedback path comprised of feedback network 103 and amplifier 102. The feedback network is most commonly a resistor divider network made up of resistors such as 105 and 106. In voltage regulators, amplifier 102 is commonly referred to as the error amplifier and is biased by a voltage that has a functional relationship to the supply such as that produced by reference generator 101. As typical in a negative feedback system, fluctuations in the current through feedback network 103 results in a counteracting change in the current supplied by pass element 104. In this manner, the voltage at $V_{out}$ remains constant independent of the current drawn from $V_{in}$.

The prevalence of portable electronics has placed increasingly restrictive demands on the performance of low power voltage regulators. In the interest of user convenience, portable electronics need to be designed for optimal power consumption to preserve battery life. One method of preserving power in an electronic system is to shift the system into different phases of power consumption depending upon the systems varying functionality requirements. This helps to preserve power due to the inverse relationship between functionality and power consumption in electronic circuits. The ratio of the variant phase currents, such as the operating current and the standby current, will increase as circuit performance is optimized. Low power consumption also requires a rapid transition between these phases. Fast transitions are desirable because a circuit in transition is dissipating more power than it does in a dormant state, but it is not yet accomplishing anything constructive for the circuit's operation.

The fast transition times required by modern circuits require rapid charge delivery in response to rapid changes in the regulated load. A bypass capacitor can deliver charge in response to very high frequency perturbations in the regulated load but is limited in the amount of charge it can supply. A linear voltage regulator can deliver charge in a sustainable and controlled manner. However, the speed of a linear voltage regulator is inherently limited by the stability requirement of its incorporated feedback loop. This is because without proper compensation a linear voltage regulator can suffer from instability and compensation limits the bandwidth of voltage regulators. The bandwidth must be limited because at high frequencies the characteristic of the loop will change from negative to positive feedback. If high frequency signals are amplified by positive feedback the circuit will become unstable and will be ineffective as a regulator. This property is one of the main drawbacks of linear voltage regulators. The most common substitute for linear voltage regulators are DC-DC switching regulators. This type of regulator also suffers from instability and tight speed constraints in that the switching speed needs to be around five times the bandwidth of the regulator. Circuits that combine the characteristics of DC-DC switching regulators and linear voltage regulators such as U.S. Pat. No. 5,309,082 to Pyane or U.S. Pat. No. 7,167,054 to Dening are not meant to alleviate the speed and power constraint but instead address the issues of power dissipation across the pass element and the high cost and poor regulation of DC-DC switching regulators.

A notable solution for the limited bandwidth problem of linear voltage regulators focuses on providing high frequency compensation that is not controlled by feedback. Such a circuit is described in U.S. Pat. No. 6,809,504 to Tang. An open loop system does not have frequency dependent stability constraints and therefore can operate at frequencies that exceed the requirements of linear voltage regulators. The implementation in the Tang circuit comprises pulse generators that input a set current to the load for a set time in response to a rapid change in the regulated current. The objective of such a circuit is for the predetermined current provided by the pulse to cancel the transient current that the slow linear regulator cannot track. The advantage of this approach is that the circuit can operate at very high frequency as there is no stability limitation on a system that does not have a feedback path. This approach carries a related disadvantage in that the open loop approach cannot measure and apply the exact current required. In some cases the predetermined compensation current may be so far from the desired current that the slow linear voltage regulator would have provided a better estimate on it own.

A method applied in the field of phase-locked loops to improve the transient response of a system loop utilizes both digital and analog closed loop filters. Such phase-locked loop architectures are called hybrids. An example of such architecture can be found in U.S. Pat. No. 5,978,425 to Takla. The general purpose of the phased-locked loop is to match up the clock scheme of the input signal to the clock utilized to receive the input signal. The approach utilizes a digital loop to provide a fast, though course, adjustment of the loop during a calibration phase. After calibration, a slower analog loop provides high resolution and accuracy. If this approach is not utilized the startup time for a phase locked loop could be extremely large. Control circuitry is necessary to determine when the digital loop has served its purpose and the analog loop can take over. Such a system utilizes the fast settling of a digital loop and the accuracy of an analog loop as complements to avoid the drawbacks and enhance the benefits of the respective loops.

The approach of utilizing analog and digital loops in tandem to improve the transient response of an electronic system can be applied to voltage regulators. An example of such a solution is developed further in the previously mentioned patent to Tang and is fully described in U.S. Pat. No. 6,975,494 also to Tang. This circuit incorporates a typical linear voltage regulator and augments its performance by adding independent discrete current sources controlled by voltage sensing circuitry on the load. The linear feedback circuit operates by voltage sensing changes in the regulated voltage through a feedback system. Likewise, the added circuitry functions by voltage sensing changes in the circuit and applying a set amount of current in response to the sensed voltage passing specific thresholds. The range in between these thresholds over which the discrete current boosting is not activated is called the dead zone. Unlike the open loop system this portion of the circuit can be subject to instability and oscillations due to its utilization of sensing and feedback.

An embodiment of the Tang approach is circuit 200 illustrated in FIG. 2. The circuit utilizes typical voltage regulator 201 that regulates the voltage at node $V_{out}$ using an analog feedback loop which is stabilized by capacitor 203. The circuit also uses an independent discrete current source in a nonlinear feedback loop comprised of compare and control circuitry 206, voltage transform circuitry 202 and discrete current sources 208 and 207. The discrete current sources are not active for a range of voltages around the targeted regulated voltage at node $V_{out}$. The passive components required for stability are inductor 204 and storage capacitor 205. For rapid variations in the current to load 209 discrete current sources 207 and 208 will activate and either source or sink current. However, during stable operation the nonlinear feedback loop is functioning in the dead zone and only the linear analog loop in regulator 201 will be active, while current sources 207 and 208 will be off. The span of $V_{out}$ for which the discrete nonlinear feedback loop is inactive is called the dead zone and is set by the voltages delivered to nodes $V_{r+\Delta 1}$ and $V_{r+\Delta 2}$.

SUMMARY OF INVENTION

In one aspect of the invention, a circuit for regulating a voltage with minimal power and a rapid transient response is provided. A linear voltage regulator receives an unregulated input voltage node on one terminal of its pass element and provides a regulated voltage node. A feedback network and an amplifier adjust the current flowing through the pass element so that the regulated voltage node remains at a constant voltage. The constant voltage is determined by the feedback network and a reference voltage provided to the amplifier. A compare and control circuit is coupled to the feedback network and senses variations in the potential of at least one node in the network. This node could be the regulated voltage node or it could be a voltage that is coupled to the amplifier. Furthermore, this compare and control circuit adjusts the drive capability of the pass element in response to variations in the monitored nodes.

In another aspect of the invention, a method for regulating a voltage in response to rapid changes in the load is provided. First, the voltage is regulated using a linear voltage regulator in response to low frequency perturbations in the load. Concurrently, the voltage at certain sense nodes is monitored by compare and control circuitry to detect high frequency perturbations in the regulated load. In response to the detection of these high frequency perturbations, a control signal is generated to alter the drive capability of the linear voltage regulator's pass element. The drive capability is altered to produce a corresponding change in the regulated voltage node. The compare and control circuitry continues to monitor the selected node voltages of the regulated circuit to determine when the regulated voltage is within a certain range of the desired value. Once the voltage at the regulated voltage node is within such a tolerance the compare and control circuitry resets the drive capability of the pass element to its original value.

DETAILED DESCRIPTION OF THE PREFERRED EMBODIMENTS

Reference now will be made in detail to embodiments of the disclosed invention, one or more examples of which are illustrated in the accompanying drawings. Each example is provided by way of explanation of the present technology, not as a limitation of the present technology. In fact, it will be apparent to those skilled in the art that modifications and variations can be made in the present technology without departing from the spirit and scope thereof. For instance, features illustrated or described as part of one embodiment may be used on another embodiment to yield a still further embodiment. Thus, it is intended that the present subject matter covers such modifications and variations as come within the scope of the appended claims and their equivalents.

A need exists for a low power linear voltage regulator with a broad bandwidth control loop. The feedback control loop of the linear voltage regulator comprises the limiting factor in a broad bandwidth design. The loop must be augmented or altered in some fashion to alleviate the stability constrained power and speed relationship that is inherent in the application of negative feedback. The combination of a linear series regulator and a switching regulator in open or closed loop configuration such as in the Payne approach will not likely alleviate the speed constraint because switching regulators are usually more bandwidth limited than linear regulators. The Tang approach is also problematic because the addition of a separate digital feedback loop will likely require separate stabilization circuitry, independent current sources, additional power, and separate circuitry for generating $V_{ref}$ derivative comparison points.

Figure 3:
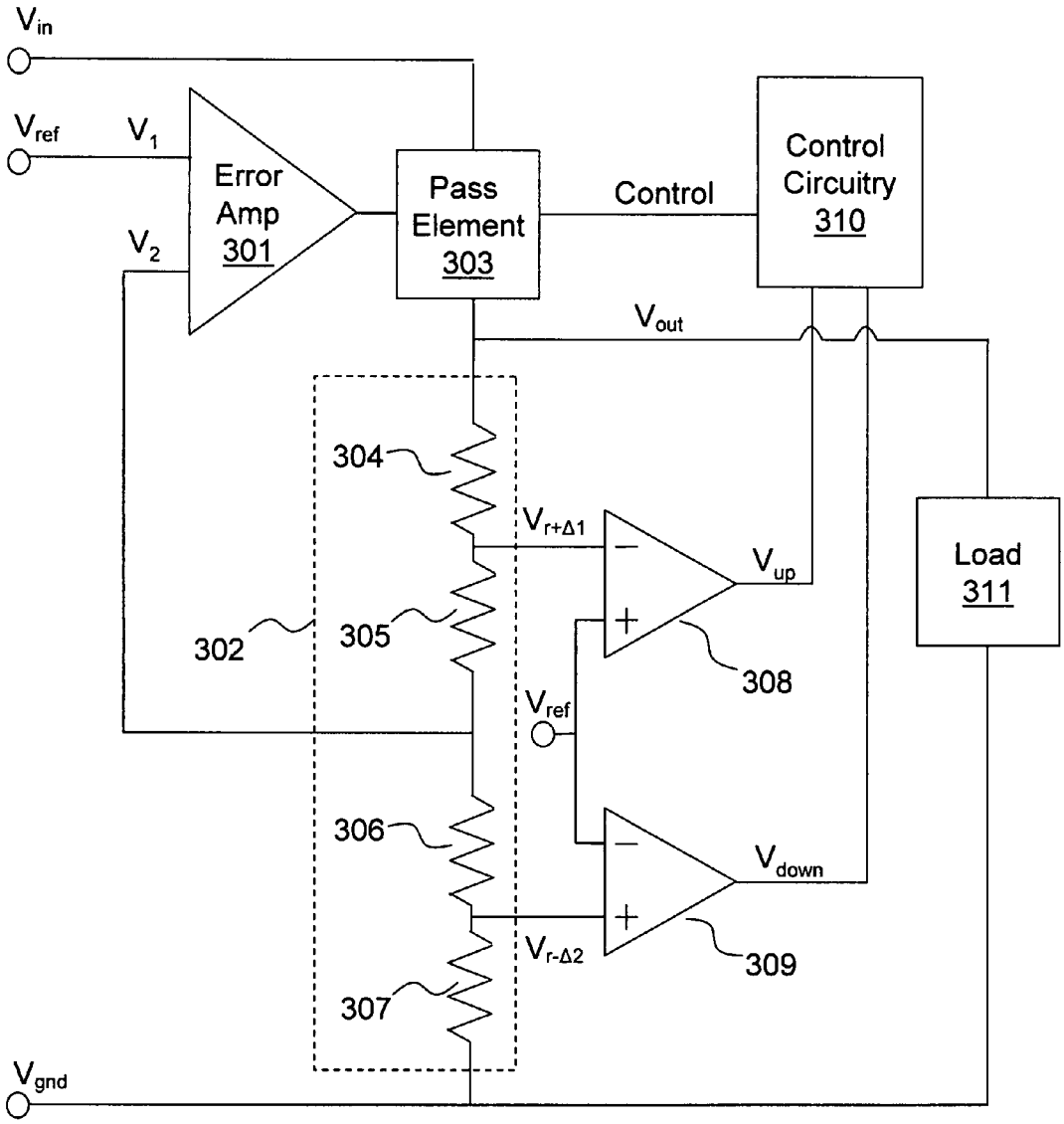
FIG. 3 illustrates a circuit for improving the transient response of a voltage regulator that is consistent with the present invention.

The present invention utilizes a hybrid loop wherein the transconductance of the pass element is altered by a nonlinear feedback path. FIG. 3 illustrates circuit 300 which is an embodiment of the present invention. The circuit contains all of the components of a typical linear voltage regulator which are illustrated by feedback network 302, error amplifier 301, and pass element 303. As in a linear voltage regulator, a first terminal $V_1$ of error amplifier 301 is attached to $V_{ref}$, and a second terminal $V_2$ is connected to feedback network 302. The circuit additionally comprises nonlinear transconductance adjustment circuitry that enhances the action of the linear regulator in response to rapid variations in regulated load 311. This nonlinear circuitry is comprised of comparators 309 and 308 and control circuitry 310. When load 311 is not varying at a faster rate than the linear regulator can track, the additional nonlinear circuit is in a stable state known as its dead zone.

When rapid variations in regulated load 311 occur, the linear regulator may not be able to keep pace and the regulated voltage will shift. In such cases, the linear loop is not able to keep up with a fast transient voltage swing on $V_{out}$ and the voltages at $V_{r+\Delta 1}$ and $V_{r+\Delta 2}$ will swing in the same direction almost instantaneously since these nodes are DC coupled. For a large positive change in the current drawn by load 311, such that the voltage at nodes $V_{r+\Delta 1}$ sinks below $V_{ref}$, comparator 308 will trip and send a signal to control circuitry 310 through node $V_{up}$. Likewise, if there is a large negative change in the current drawn by load 311 then the voltage at node $V_{r-\Delta 2}$ will rise above $V_{ref}$ which will trip comparator 309. Comparator 309 will then send a signal to control circuitry 310 through node $V_{down}$. Control circuitry 310 outputs a digital code along bus Control to pass element 303 based on the signals it receives. The digital code sent along Control will adjust the transconductance of pass element 303 to provide for faster settling of the regulator.

The embodiment of the present invention illustrated in FIG. 3 has the distinct advantage of having comparator sense voltages available from the circuit without the need for additional circuitry and power consumption. Since the transconductance control portion of the loop and the linear portion of the loop share the same feedback network, there is no additional current required to generate the input voltages to comparators 308 and 309. In addition, the points at which comparators 308 and 309 sense voltages from feedback network 302 are very flexible from a design perspective, as there will be a negligible resultant effect on the analog feedback loop. The implementation is simple considering the fact that resistors 304 and 305 illustrated in the figure could just be two different portions of a single resistor in the layout of a circuit. The same analysis applies to resistors 306 and 307. In addition, the reference voltage $V_{ref}$ is already required for the operation of the analog loop so it can be provided to the comparators with negligible power and cost. This advantage is not shared by the dual loop architecture, as the feedback loop requires separately generated variants of $V_{ref}$ through the use of voltage transform circuit 202. Transform circuit 202 will necessarily require power and area for generating $V_{r+\Delta 2}$ and $V_{r+\Delta 1}$.

Figure 4:
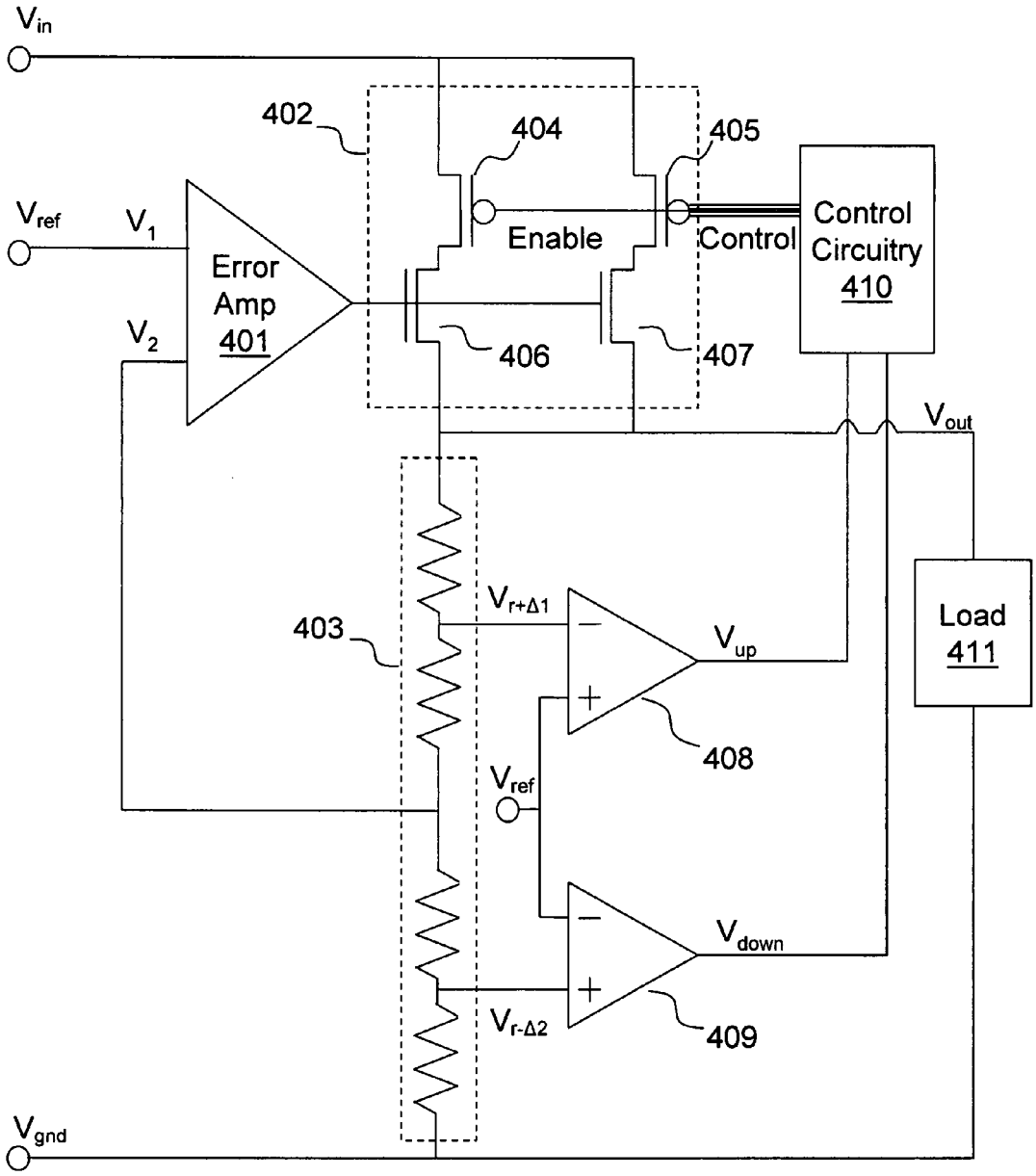
FIG. 4 illustrates an embodiment of the present invention wherein the pass element of the regulator is a switch controlled NMOS array.

There are several ways in which control circuitry 310 could alter the transconductance of pass element 303. One such method can be described with reference to FIG. 4. Circuit 400 is an implementation of circuit 300 with a switch controlled n-channel metal oxide semiconductor field effect transistor (NMOS) array 402 serving as pass element 303. Since the linear pass element is an NMOS device, input terminal $V_2$ of error amplifier 401 will be the inverting terminal and input terminal $V_1$ will be the non-inverting terminal. Control circuitry 410 controls the number of switches in switch array 405 that are active and thereby controls the number of transistors in linear pass element array 407 that are able to source load current. Switch array 405 is comprised of p-channel metal oxide semiconductor field effect transistors (PMOS). The overall size of the pass element as seen by the analog loop comprised of resistor network 403 and error amplifier 401 is set by transistor 406 and the activated transistors of linear pass element array 407. By adjusting the number of activated transistors in linear pass element array 407 the effective width of the pass element will increase or decrease. In this manner, the transconductance of the linear analog loop is adjusted by the nonlinear loop. Switch 404 is present to allow shutoff functionality for the regulator through signal Enable, and to assure matching between the bias conditions for transistor 406 and the activated transistors in linear pass element array 407.

Figure 1:
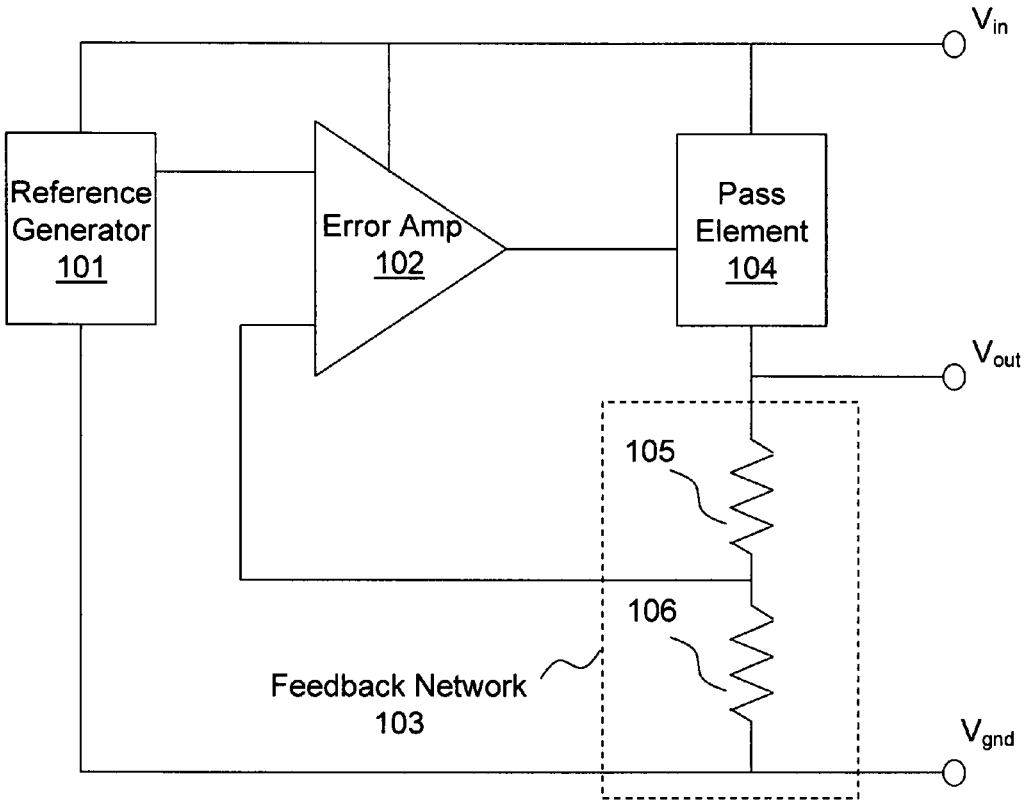
FIG. 1 illustrates a generalized linear voltage regulator.
Figure 2:
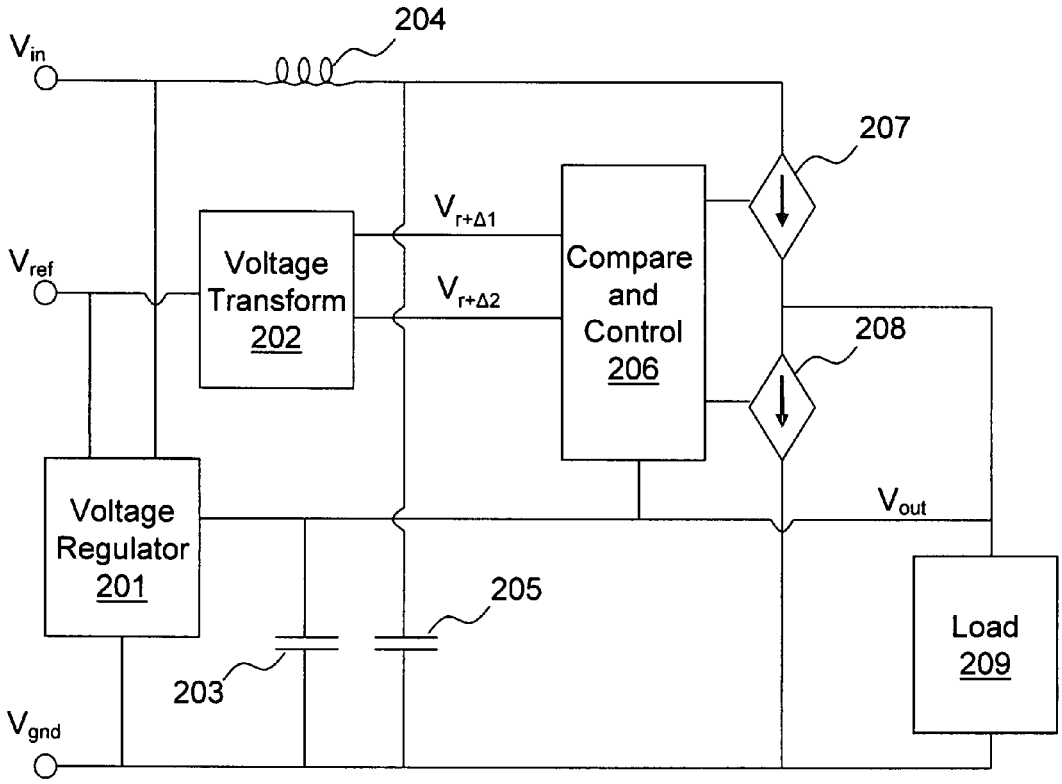
FIG. 2 illustrates a prior art method of improving the transient response of a voltage regulator.

In the dual loop regulator architecture the independent current sources cannot be providing current to the load during the nonlinear loop's dead zone. As set forth in FIG. 2, during stable operation of regulator circuit 200, linear voltage regulator 201 should be actively regulating the load and the nonlinear regulator, formed by compare and control circuitry 206 and current sources 207 and 208, must be in its dead zone. The nonlinear regulator must be in its dead zone because it does not have the resolution required to accurately regulate the load. This is in keeping with the overall objective of precise regulation. If the nonlinear circuit provides current to load 209 through current sources 207 and 208 during its dead zone, voltage regulator 201 will actively provide the additional current required in order to keep $V_{out}$ regulated at the desired voltage. This is not by itself problematic, but if the current required by load 209 drops below the current provided by current sources 207 and 208, the excess current cannot be taken in by the linear loop while maintaining regulation of $V_{out}$. This is because the most desirable linear regulator cannot provide a regulated negative current path. Therefore, if the nonlinear circuit has a non-zero dead zone output current, it will undesirably constrain the minimum regulated current. Conversely, if the nonlinear circuit is pulling current from load 209 through current sources 207 or 208 during its dead zone, the circuit will constantly be wasting power through nonlinear current source 208.

Since the nonlinear circuit cannot source or sink current when the circuit is operating in its dead zone, a single current source can only act to regulate the load in an under-voltage or an over-voltage condition. If the nonlinear loop is designed to protect against both types of variation in the regulated loop, two current sources are required. A single current source coupled from $V_{out}$ to $V_{in}$ or from $V_{out}$ to $V_{gnd}$ will provide a unidirectional source or sink from $V_{out}$. A unidirectional current path can only affect the circuit by altering its magnitude. In accordance with the required dead zone behavior, such a current source must have a zero dead zone value. The result of these requirements is that a single current source will only be able to increase the current sourced to $V_{out}$ or increase the current sunk from $V_{out}$ but cannot do both. Therefore, a current source can only alleviate a single type of transient current swing in regulated load 209.

The present invention only requires a single current path for generating the regulated current. The reason only a single path is required is that the analog linear control loop is always in ultimate control of the current provided from pass element 303 to the regulated load regardless of the nonlinear loop control signal. The current sources for separate linear and nonlinear loops will both be very large because there are certain conditions in which either loop may have to provide the maximum current required by the regulated load. Substantial area savings are therefore realized through implementation of the present invention. In addition, this single current source will function to counter an over-voltage or an under-voltage condition thereby alleviating the need for two separate current sources for under-voltage and over-voltage conditions. This leads to further size savings since the two current source approach would likely consume more area than the one current source approach.

Circuit 300 is able to react to either type of rapid load transient because of its hybrid loop configuration. The circuit can react to either transient by rapidly decreasing or increasing the transconductance of pass element 303. With reference to the specific pass element configuration in circuit 400, control circuit 410 could be outputting a midpoint code in the nonlinear circuit's dead zone. The result would be that the effective transconductance of pass element 402 from the linear loop's perspective would comprise half of transistor array 407 and transistor 406. In a rapid transient over-voltage condition at $V_{out}$, the nonlinear circuit could quickly cut the current through transistor array 407 by outputting a zero code and deactivating all of the switches in array 405. In a rapid transient under-voltage condition at $V_{out}$, the nonlinear circuit can quickly increase the current through transistor array 407 by outputting its maximum code and activating all of the switches in array 405.

The described action of the nonlinear loop has a power savings advantage in addition to the area savings that accompany the single current source configuration. Current is wasted when using the multiple current source architecture as compared to the hybrid loop approach. With reference to circuit 200, current source 208 will activate during an over-voltage condition and sink excess current to ground. Contrarily, when an over-voltage condition occurs in circuit 400, linear pass element array 407 can be cut from the supply by deactivating the active switches of array 405. Succinctly, the independent current source shunts the additional current to ground while the present invention applies less current from the supply. This will amount to a small amount of current savings each time the over-voltage condition is encountered because, in keeping with the main objective of the circuit, the transient condition is very brief. However, modern circuits make such transitions many times so the integral charge savings can be substantial.

The dead zone behavior of control circuitry 410 is not limited to the discussed embodiment wherein the circuitry outputs a midpoint code. The dead zone output code could be at any point along the spread of possible codes. The selection of a dead zone output code will affect the design of the linear loop and can be selected to focus on a particular type of transient. If over-voltage conditions were an issue, the dead zone output current of control circuit 410 could be placed at a much higher level. This design would be able to strongly reduce the current supplied in order to correct for a rapid over-voltage transient. If under-voltage conditions were more of a concern for a particular load, the dead zone output code could be shifted towards the other end of the code range. In keeping with this approach, the transistors in array 405 and 407 do not have to be linearly sized. The midpoint code could still be output but the size of the devices controlled by each code could change in a nonlinear fashion dependent upon the particularized load transients of concern and the desired accuracy and settling time of the hybrid loop. In the extreme, control circuitry 410 could output a zero or maximum code while the nonlinear transconductance adjustment loop is in the dead zone. Such a circuit would only be able to rapidly respond to one type of voltage swing but would do so in an effective manner. An additional benefit of such a configuration would be that the nonlinear loop would not oscillate independently of the nonlinear loop. Several variations of this approach could easily be implemented since they would only require modifications to the digital logic in control circuitry 410.

The control and feedback detection circuitry can be implemented in several ways. FIG. 3 displays a very specific embodiment. In another embodiment there could be any number of comparators similar to 309 and 308 that tap off of feedback network 302 at several different points. Additionally, a comparator could detect changes in the voltage at $V_{out}$ instead of voltages at nodes along feedback network 302. Instead of detecting different nodes in the circuit against $V_{ref}$ the compare circuitry could measure a single node such as $V_{out}$ against several variant voltage references. The various types of detection circuits available could be combined with enhanced control intelligence in circuit block 310. For example, the circuit could measure the time variant derivative of the detected voltages and apply a control signal that took advantage of this information by applying a large current in anticipation of an increased current drawn by the load. Many other variations of such enhanced intelligence are available to the designer. These techniques could be combined with methods of selecting switch sizes in an implementation of the invention similar to FIG. 4.

Figure 5:
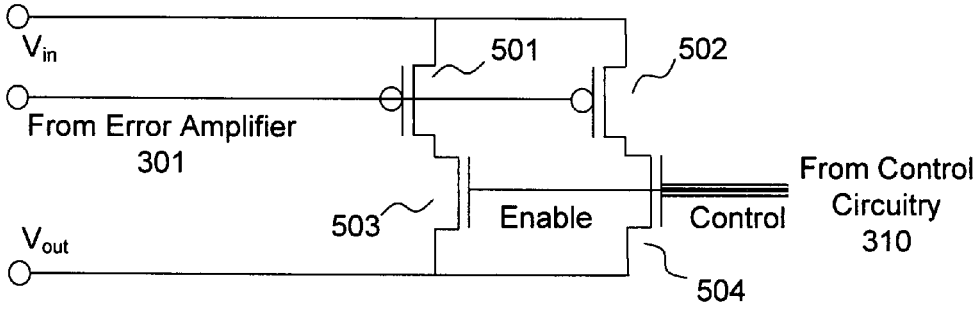
FIG. 5 illustrates several variations for the pass element circuitry of a voltage regulator consistent with the present invention.
Figure 5:
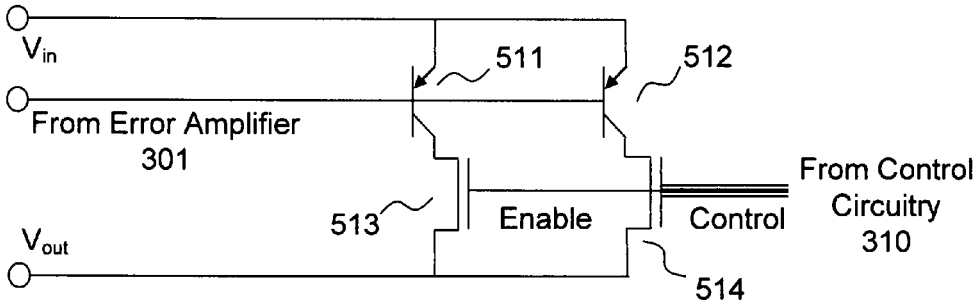
Figure 5:
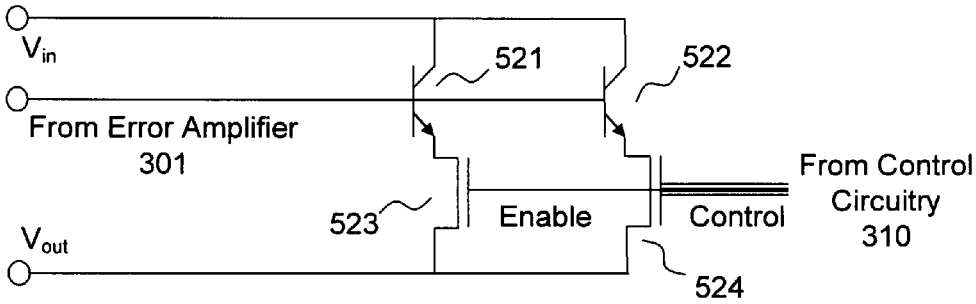

Another set of embodiments of the invention use different devices as linear pass elements. FIG. 5 is an illustration of three circuit blocks 500, 510, and 520 that can be used in place of pass element 303 in circuit 300. In circuit block 500, the linear driven pass element devices 501 and 502 are PMOS devices. In such a configuration, terminal $V_2$ in FIG. 3 would have to be the non-inverting terminal while $V_1$ would be the inverting terminal of error amp 301. In this configuration enable switch 503 and switch array 504 are NMOS and are coupled between the pass element current source devices and the load at $V_{out}$.

A similar configuration is shown in circuit block 510 where the current source pass element devices are PNP BJTs 511 and 512. Switches 513 and 514 are configured in the same manner as for the PMOS source pass elements of circuit block 500. Error amplifier 301 would also have the same configuration as for the circuit block 500 in terms of the error amplifier's input terminal connections. Circuit block 520 is another implementation of the circuit wherein the current source pass element devices are NPN BJTs 521 and 522. In this case, error amplifier 301 would have the same configuration as for the NMOS current source implementation of FIG. 4. Terminal $V_1$ would be the non-inverting terminal and terminal $V_2$ would be the inverting terminal. In this configuration, it is important to keep switch 523 and the switches in array 524 equally proportioned with the transistor branch they are attached to in order to preserve matching bias conditions for the BJTs. In these implementations the signal from control circuit 310 will have an opposite output format as control circuitry 410. The control circuitry will output a high signal to activate the NMOS switches.

Figure 6:
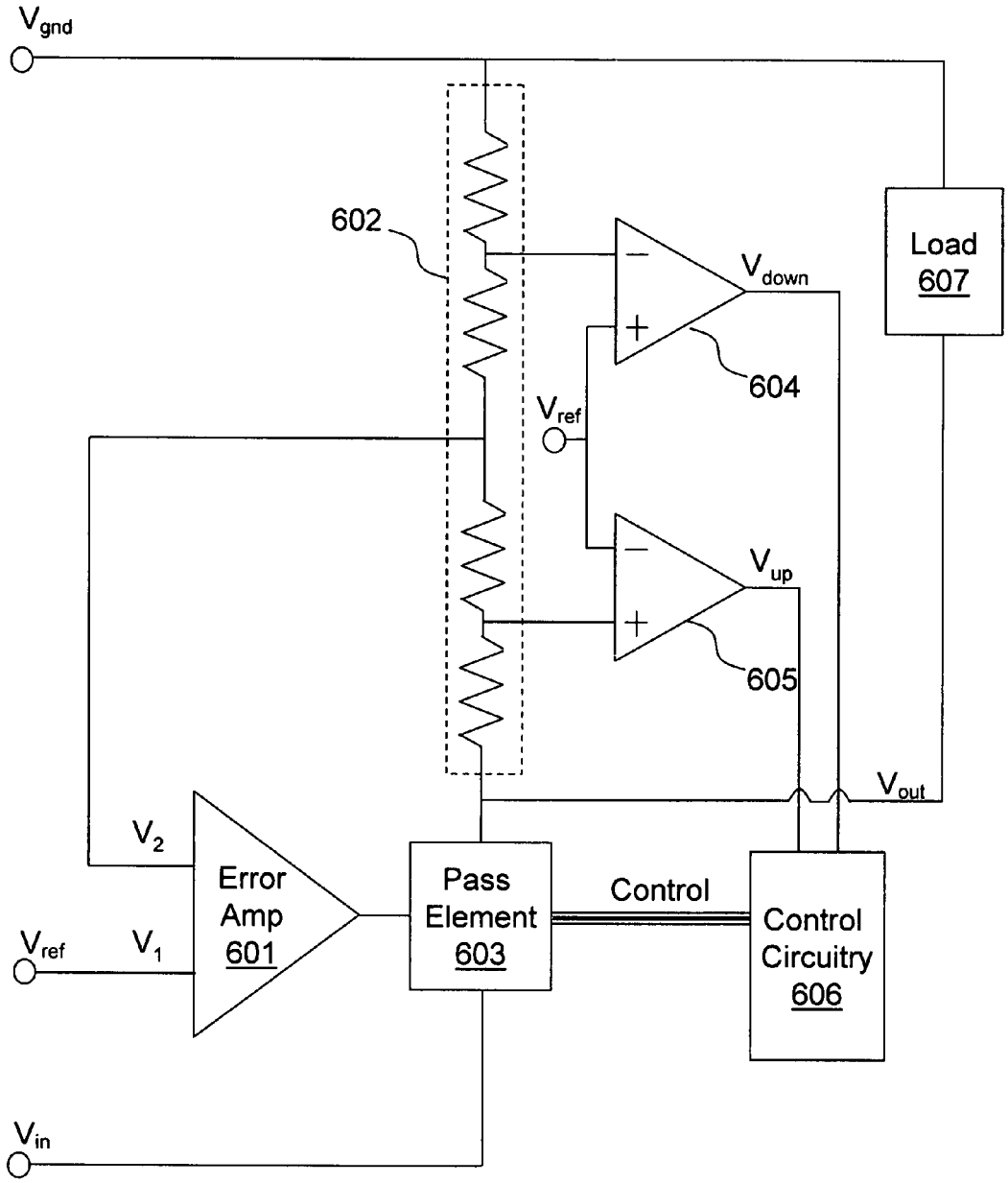
FIG. 6 illustrates an embodiment of the present invention applied in a negative voltage regulator configuration.

In another embodiment of the invention, broad bandwidth low power regulation is achieved in negative regulator configuration. Such a configuration 600 is illustrated in FIG. 6. In such a configuration, the regulated voltage $V_{out}$ is less than ground voltage $V_{gnd}$ but is more than the input voltage $V_{in}$. Pass element 603, error amplifier 601, control circuitry 606, and comparators 604 and 605 still have the same functional relationship to each other as in the positive regulator configuration. In addition, the terminals of error amplifier 601 will be configured in the same configuration as they would for the positive regulator for any given linear pass element device in pass element 603. For example, if the pass element was an array of NMOS transconductance amplifiers, input terminal $V_1$ would be the non-inverting terminal and $V_2$ would be the inverting terminal. The main difference is that the comparator that is sensing the higher voltage 604 outputs a signal for the pass element to decrease its transconductance $V_{down}$, and comparator 605 outputs a signal for the pass element to increase its transconductance $V_{up}$. This circuit would most commonly be used to create a regulated ground voltage for a load configured in the same fashion as load 607 in circuit 600.

The invention will function with any form of stabilization circuit for frequency compensation of the analog loop. It should be noted that one of the advantages of the present invention is that it alleviates the stability constraint placed on the circuit indirectly by increasing the transient response capabilities of the regulator. The commensurate increase in speed can be traded off to improve stability while maintaining the speed and power relationship of a circuit that does not utilize the present invention. Other techniques in the field of voltage regulators can be used together with the present invention to enhance its performance. Such techniques include the use of drive signals that are brought up to voltages in excess of the supply voltage or down to voltages below the ground voltage through the use of charge pumps.

Figure 7:
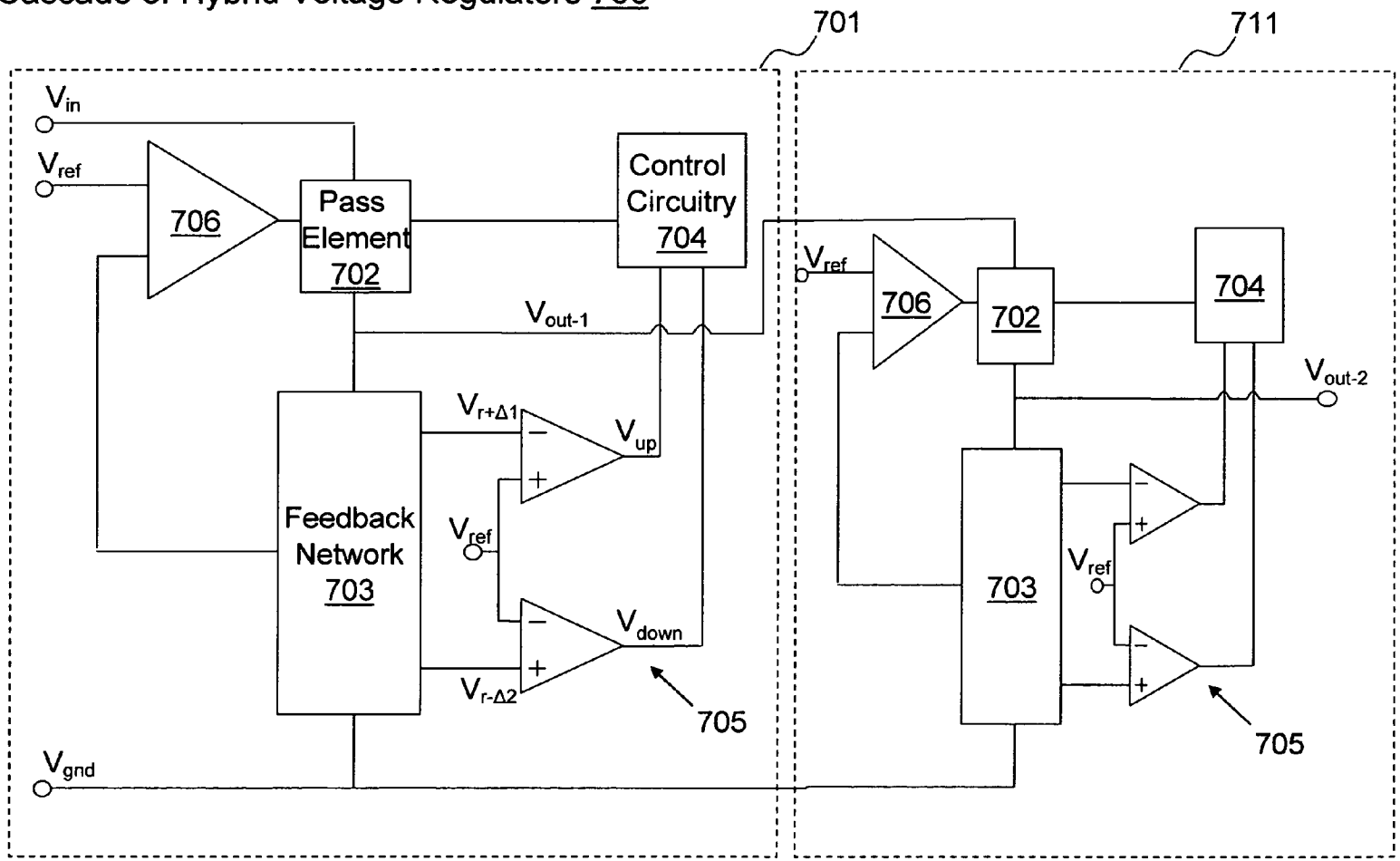
FIG. 7 illustrates an embodiment of the present invention applied in a cascade of voltage regulators.

In another embodiment of the invention, the transient response improvement scheme is applied to a cascade of regulators. In such an embodiment, the output of each regulator is applied as the input of a succeeding regulator. The resultant configuration provides for multiple power islands on a single chip. An illustration of two stages of such a configuration is circuit 700 in FIG. 7. The first stage is 701, and the second stage is 711. The stages are each generalized embodiments of the present invention. The linear analog control loop is formed by error amplifier 706, pass element 702, and feedback network 703. The drive capability control path is formed by feedback network 703, sensing circuitry 705, and control circuitry 704. As shown in the illustration, the output $V_{out\text{-}1}$ of first stage 701 is the input of second stage 711. The voltage $V_{out\text{-}2}$ would be another regulated voltage with a different value based on the feedback network of stage 711 and the value of $V_{ref}$. Multiple instantiations of circuit 701 could be added on to the cascade with device size parameters altered for the particular voltages desired. The only limitation on successive outputs of the cascade would be that their value would be constrained tighter between $V_{in}$ and $V_{gnd}$ based on the number of preceding states.

Although embodiments of the invention have been discussed primarily with respect to specific embodiments thereof, other variations are possible. Various voltage regulator configurations may be used in place of, or in addition to, the circuit configurations presented herein. Functions may be performed by hardware or software, as desired. In general, any circuit diagrams presented are only intended to indicate one possible configuration, and many variations are possible. Those skilled in the art will also appreciate that methods and systems consistent with the present invention are suitable for use in a wide range of applications encompassing any that utilize feedback loops. While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those skilled in the art, without departing from the spirit and scope of the present invention, which is more particularly set forth in the appended claims. Furthermore, those skilled in the art will appreciate that the foregoing description is by way of example only, and is not intended to limit the invention.

What is claimed is:

1. A hybrid loop voltage regulator circuit for voltage regulation of a load, said hybrid loop voltage regulator comprising:

an amplifier having a first input terminal coupled to a reference voltage node, a second input terminal, and an output terminal;

a pass element having a first terminal coupled to said output terminal of said amplifier, a second terminal coupled to a regulated voltage node, a third terminal for controlling the drive capability of said pass element, and a fourth terminal coupled to an unregulated input voltage node;

a feedback network coupled to a regulated voltage node, a ground voltage node, and said second input terminal of said amplifier, said feedback network having nodes at various intermittent potentials from said regulated voltage node to said ground node; and a compare and control circuit coupled to said feedback network and said third terminal of said pass element;

wherein said compare and control circuit augments the drive capability of said pass element in response to variations in the voltage of one of said nodes of said feedback network to improve the transient performance of the circuit.

2. The regulator of claim 1, wherein said unregulated voltage has one of a higher potential and a lower potential than said regulated voltage.

3. The regulator of claim 1, said feedback network further comprising:

a first resistor coupled from said regulated voltage node to an output proximate potential terminal of a second resistor; and a third resistor coupled from a near center terminal of said second resistor to a ground proximate potential terminal of a fourth resistor that couples said ground proximate potential terminal to said ground voltage node;

wherein said output proximate potential terminal provides a first sensing point for said compare and control circuit, said near center terminal provides a feedback sensing point coupled to said second input terminal of said amplifier, and said near ground potential terminal provides a second sensing point for said compare and control circuit.

4. The regulator of claim 1, said pass element further comprising:

a current path switch having a control terminal individually coupled to a third terminal of said pass element; and an active current source having a current control terminal coupled to said first terminal of said pass element, and having a regulated current path terminal individually coupled to a particular said current path switch;

wherein said current path switch can be set into one of an activated state and a deactivated state by said compare and control circuitry; and wherein said active current source is configured to provide a current path from said fourth terminal of said pass element to said second terminal of said pass element when said particular said individual current path switch is set in said activated state.

5. The regulator of claim 4, said pass element further comprising:

a p-channel field effect transistor switch array including two individual p-channel transistor switches each having a p-channel transistor gate terminal that is individually coupled to said third terminal of said pass element, a p-channel transistor source terminal couple to said fourth terminal of said pass element, and a p-channel transistor drain terminal; and an n-channel field effect transistor linear pass element array including two individual n-channel transistor transconductance amplifiers each having an n-channel transistor drain terminal that is individually coupled to a single said p-channel transistor drain terminal of said p-channel transistor switches, an n-channel transistor source terminal coupled to said second terminal of said pass element, and an n-channel transistor gate terminal that is coupled to said first terminal of said pass element;

wherein said coupling at said third terminal is by means of a control bus capable of sending control signals to each said p-channel transistor gate terminal individually to adjust said drive capability of said pass element.

6. The regulator of claim 4, said pass element further comprising: an n-channel field effect transistor switch array including two individual n-channel transistor switches each having an n-channel transistor gate terminal that is individually coupled to said third terminal of said pass element, a n-channel transistor source terminal couple to said second terminal of said pass element, and an n-channel transistor drain terminal; and an p-channel field effect transistor linear pass element array including two individual p-channel transistor transconductance amplifiers each having a p-channel transistor drain terminal that is individually coupled to a single said n-channel transistor drain terminal of said n-channel transistor switches, a p-channel transistor source terminal coupled to said fourth terminal of said pass element, and a p-channel transistor gate terminal that is coupled to said first terminal of said pass element;

wherein said coupling at said third terminal is by means of a control bus capable of sending control signals to each said n-channel transistor gate terminal individually to adjust said drive capability of said pass element.

7. The regulator of claim 4, said pass element further comprising:

an n-channel field effect transistor switch array including two individual n-channel transistor switches each having an n-channel transistor gate terminal that is individually coupled to said third terminal of said pass element, a n-channel transistor source terminal couple to said second terminal of said pass element, and an n-channel transistor drain terminal; and a p-n-p bipolar junction transistor linear pass element array including two individual p-n-p transistor current amplifiers each having a collector terminal that is individually coupled to a single said n-channel transistor drain terminal of said n-channel transistor switches, an emitter terminal coupled to said fourth terminal of said pass element, and a base terminal that is coupled to said first terminal of said pass element;

wherein said coupling at said third terminal is by means of a control bus capable of sending control signals to each said n-channel transistor gate terminal individually to adjust said drive capability of said pass element.

8. The regulator of claim 4, said pass element further comprising:

an n-channel field effect transistor switch array including two individual n-channel transistor switches each having an n-channel transistor gate terminal that is individually coupled to said third terminal of said pass element, a n-channel transistor source terminal couple to said second terminal of said pass element, and an n-channel transistor drain terminal; and a n-p-n bipolar junction transistor linear pass element array including two individual n-p-n transistor current amplifiers each having an emitter terminal that is individually coupled to a single said n-channel transistor drain terminal of said n-channel transistor switches, a collector terminal coupled to said fourth terminal of said pass element, and a base terminal that is coupled to said first terminal of said pass element;

wherein said coupling at said third terminal is by means of a control bus capable of sending control signals to each said n-channel transistor gate terminal individually to adjust said drive capability of said pass element.

9. The regulator of claim 1, said compare and control circuitry comprising:

a comparator having a sensing input terminal coupled to one of said nodes of said feedback network, a voltage reference input terminal coupled to said reference voltage node, and a comparator output terminal coupled to control circuitry;

wherein said comparator is configured for sending a signal to said control circuitry from said comparator output terminal when a sensed voltage at said sensing input terminal crosses the voltage at said voltage reference input terminal.

10. The regulator of claim 1, said compare and control circuitry comprising:

a comparator having a sensing input terminal coupled to one of said nodes of said feedback network, a voltage reference input terminal couple to a particular reference voltage node, and a comparator output terminal coupled to control circuitry;

wherein said comparator is configured for sending a signal to said control circuitry from said comparator output terminal when a sensed voltage at said sensing input terminal crosses the voltage at said voltage reference input terminal.

11. The regulator of claim 1, said nodes comprising:

an over-voltage detection node set at a lower potential than a feedback node coupled to said amplifier; and an under-voltage detection node set at a higher potential than said feedback node;

wherein said lower potential and said higher potential are set to provide improved transient performance while maintaining stability.

12. The regulator of claim 1, said pass element further comprising:

an active current source formed by an array of multiple fingers of similar devices coupled between said regulated voltage node and said unregulated voltage node, and coupled to control circuitry;

wherein said control circuitry is capable of altering said multiple fingers between activated and deactivated states; and wherein said multiple fingers are able to conduct current between said regulated voltage node and said unregulated voltage node when in said activated state.

13. A method for regulating an output voltage across a load at a regulated voltage with a hybrid voltage regulator, comprising the steps of:

regulating said output voltage across said load in response to low frequency perturbations utilizing a linear voltage regulator feedback system;

monitoring a voltage at sense voltage nodes in a feedback loop of said linear voltage regulator feedback system to detect high frequency perturbations;

generating a control signal in response to detection of said high frequency perturbations;

altering a drive capability of a pass element of said linear voltage regulator feedback system from an original dead zone value in response to said control signal to temporarily increase a speed of said linear voltage regulator feedback system;

measuring said sense voltage nodes in said feedback loop to detect when said voltage across said load is within a range of said regulated voltage; and resetting the drive capability of said pass element to said original dead zone value.

14. The method of claim 13, wherein said sense voltage nodes are comprised of an under-voltage node and an over-voltage node;

wherein said monitoring detects high frequency perturbations when said under-voltage node has a higher potential than a reference voltage or said over-voltage node has a lower potential than said reference voltage; and wherein said measuring detects when said output voltage across said load is within said range of said regulated voltage when said under-voltage has a lower potential than said reference voltage and said over-voltage node has a higher potential than said reference voltage.

15. The method of claim 13, wherein said sense voltage nodes comprise a single detection node;

wherein said monitoring detects high frequency perturbations when said single detection node is at least one of a higher potential than a reference voltage and a lower potential than said reference voltage;

wherein said measuring detects when said output voltage across said load is within a range of said regulated voltage when said single detection node has a potential closer to the potential said single detection node has when said output voltage has is at a potential substantially equivalent to said regulated voltage than to said reference voltage; and wherein said altering the drive capability of said pass element is unidirectional from said original dead zone value.

16. The method of claim 13, wherein said sense voltage nodes comprise a single detection node;

wherein said monitoring detects high frequency perturbations when at least one of said single detection node has a higher potential than a high reference voltage node, and said single detection node has a lower potential than a low reference voltage node;

wherein said measuring detects when said output voltage across said load is within a range of said regulated voltage when said single detection node has a lower potential than said high reference voltage node and said single detection node has a higher potential than said low reference voltage node; and wherein said high reference voltage node has a higher potential than any of the said low reference voltage nodes.

17. The method of claim 13, wherein said altering the drive capability of said pass element is accomplished by adjusting a geometry of an active device that comprises said pass element; and wherein said drive capability is increased by increasing a current limiting geometric factor and said drive capability is decreased by decreasing the current limiting geometric factor.

18. The method of claim 17, wherein said adjusting the geometry of an active device is accomplished in a nonlinear fashion to provide improved transient response based on a particular common transient behavior of said load.

19. The method of claim 13, wherein said original dead zone value induces a minimum drive capability of said pass element; and wherein said altering the drive capability of said pass element is unidirectional from said dead zone value.

20. The method of claim 13, wherein said original dead zone value induces at least one of a mid point, close to minimum, and close to maximum drive capability of said pass element; and wherein said original dead zone value is selected to more efficiently regulate said load in response to a particular type of said high frequency perturbation.

* * * * *